US011287195B2

(12) United States Patent
Hall

(10) Patent No.: US 11,287,195 B2
(45) Date of Patent: Mar. 29, 2022

(54) INTEGRAL EVAPORATOR HEADER LIQUID SUCTION HEAT EXCHANGER

(71) Applicant: Rheem Manufacturing Company, Atlanta, GA (US)

(72) Inventor: Charles G. Hall, Brookhaven, GA (US)

(73) Assignee: Rheem Manufacturing Company, Atlanta, GA (US)

( * ) Notice: Subject to any disclaimer, the term of this patent is extended or adjusted under 35 U.S.C. 154(b) by 163 days.

(21) Appl. No.: 16/673,502

(22) Filed: Nov. 4, 2019

(65) Prior Publication Data

US 2020/0141664 A1 May 7, 2020

Related U.S. Application Data

(60) Provisional application No. 62/756,474, filed on Nov. 6, 2018.

(51) Int. Cl.

| | |
|---|---|
| ***F25B 1/00*** | (2006.01) |
| ***F28F 9/02*** | (2006.01) |
| ***F25B 13/00*** | (2006.01) |
| ***F25B 39/02*** | (2006.01) |

(52) U.S. Cl.

CPC ..... *F28F 9/02* (2013.01); *F25B 13/00* (2013.01); *F25B 39/028* (2013.01)

(58) Field of Classification Search

CPC . F28F 9/02; F28F 9/0234; F25B 13/00; F25B 39/028; F25B 2400/054; F25B 40/00; F25B 41/42; F28D 2021/0071; F28D 7/10; F28D 7/106; F28D 1/0461

USPC ..... 62/115

See application file for complete search history.

(56) References Cited

U.S. PATENT DOCUMENTS

2016/0054076 A1* 2/2016 Krell ..... F28F 9/162 165/175
2018/0156512 A1* 6/2018 Mislak ..... F25B 39/028
2018/0304321 A1* 10/2018 Visser ..... B08B 9/08

FOREIGN PATENT DOCUMENTS

WO WO-2011023192 A2 * 3/2011 ..... F25B 40/00

* cited by examiner

*Primary Examiner* — Henry T Crenshaw
*Assistant Examiner* — Kamran Tavakoldavani
(74) *Attorney, Agent, or Firm* — Troutman Pepper Hamilton Sanders LLP

(57) ABSTRACT

An evaporator includes an integral liquid suction heat exchanger that is disposed in a housing of the evaporator. The integral liquid suction heat exchanger is defined by an evaporator header of the evaporator and a portion of a liquid line that extends through an inner cavity defined by the evaporator header such that: (a) the evaporator header and the portion of the liquid line form a tube-in-tube structure, and (b) refrigerant from the evaporator coils that is channeled into the inner cavity of the evaporator header is superheated and converted to a vapor state in the evaporator header by heat from the refrigerant flowing through the liquid line. The refrigerant flowing through the liquid line is in a liquid state and has a higher temperature than the refrigerant from the evaporator coils that is in a two-phase state.

18 Claims, 15 Drawing Sheets

INTEGRAL EVAPORATOR HEADER LIQUID SUCTION HEAT EXCHANGER

RELATED APPLICATIONS

The present application claims priority to U.S. Provisional Patent Application No. 62/756,474 filed Nov. 6, 2018 and titled "Integral Evaporator Header Liquid Suction Heat Exchanger," the entire content of which is incorporated herein by reference.

TECHNICAL FIELD

The present disclosure relates generally to temperature control systems, and more particularly to a direct expansion refrigeration system with an integral evaporator header liquid suction heat exchanger.

BACKGROUND

Direct expansion refrigeration systems typically include an indoor evaporator unit with evaporator coils that are configured to pass a refrigerant therethrough. The refrigerant passing through the evaporator coils absorbs heat from air that is to be conditioned, expands, and eventually converts to vapor. To prevent any of the refrigerant from entering a compressor of the refrigeration system in a liquid state, conventional direct expansion refrigeration systems superheat the refrigerant to the vapor state inside the evaporator coils using the air that is to be conditioned. However, superheating the refrigerant inside the evaporator coils reduces the evaporator capacity and efficiency because the refrigerant in the vapor state does not absorb much heat from the air that is to be conditioned. That is, the portion of the evaporator coil where the refrigerant is operated in the vapor state experiences low refrigerant to air heat transfer when compared to a remainder of the evaporator coil where the refrigerant is operated in a two-phase state, thereby reducing an overall efficiency and capacity of the evaporator. Further, the superheat is limited to the temperature difference between the air that is to be conditioned and the temperature of the refrigerant in the evaporator coils.

In view of the recent changes to the efficiency requirements for refrigeration systems, e.g., requirements mandated by the United States Department of Energy (DOE) for the year 2020, there is an imminent need to improve the efficiency and capacity of refrigeration systems. One method to improve the efficiency of the refrigeration systems is to increase the surface area of the evaporator coils by either increasing the number of evaporator coils and/or the length of the evaporator coils. However, said method of increasing the surface area of the evaporator coils would result in added material cost, thereby increasing the overall price of the refrigeration systems which may be undesirable. Another method to improve the capacity of the refrigeration systems is to increase the fan speed and/or increase the amount of air blown across the evaporator coils. However, said method of increasing the fan speed or volume of air blown across the evaporator coils consumes more power and may not meet the efficiency requirements mandated by the DOE. Further, both the above mentioned methods would require a size or footprint of the evaporator to be increased which may be impractical considering that the evaporator is an indoor unit and there are space constraints. Yet another method to improve the efficiency of the refrigeration systems is to use a suction heat exchanger that superheats the refrigerant from the evaporator using the hot condensate refrigerant liquid from the condenser. However, conventional suction heat exchangers are only available as an external option that can be field installed outside of the evaporator, which may be undesirable because it results in additional cost to the end user and would require labor for installation. Further, in said method using suction heat exchangers installed external to the evaporator, sensing elements associated with the operation of the expansion valve of the refrigeration system would have to be located external to the evaporator at the outlet of the suction heat exchanger where the refrigerant is superheated, which may be undesirable.

It is noted that this background information is provided to reveal information believed by the applicant to be of possible relevance to the present disclosure. No admission is necessarily intended, nor should be construed, that any of the preceding information constitutes prior art against the present disclosure.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1:
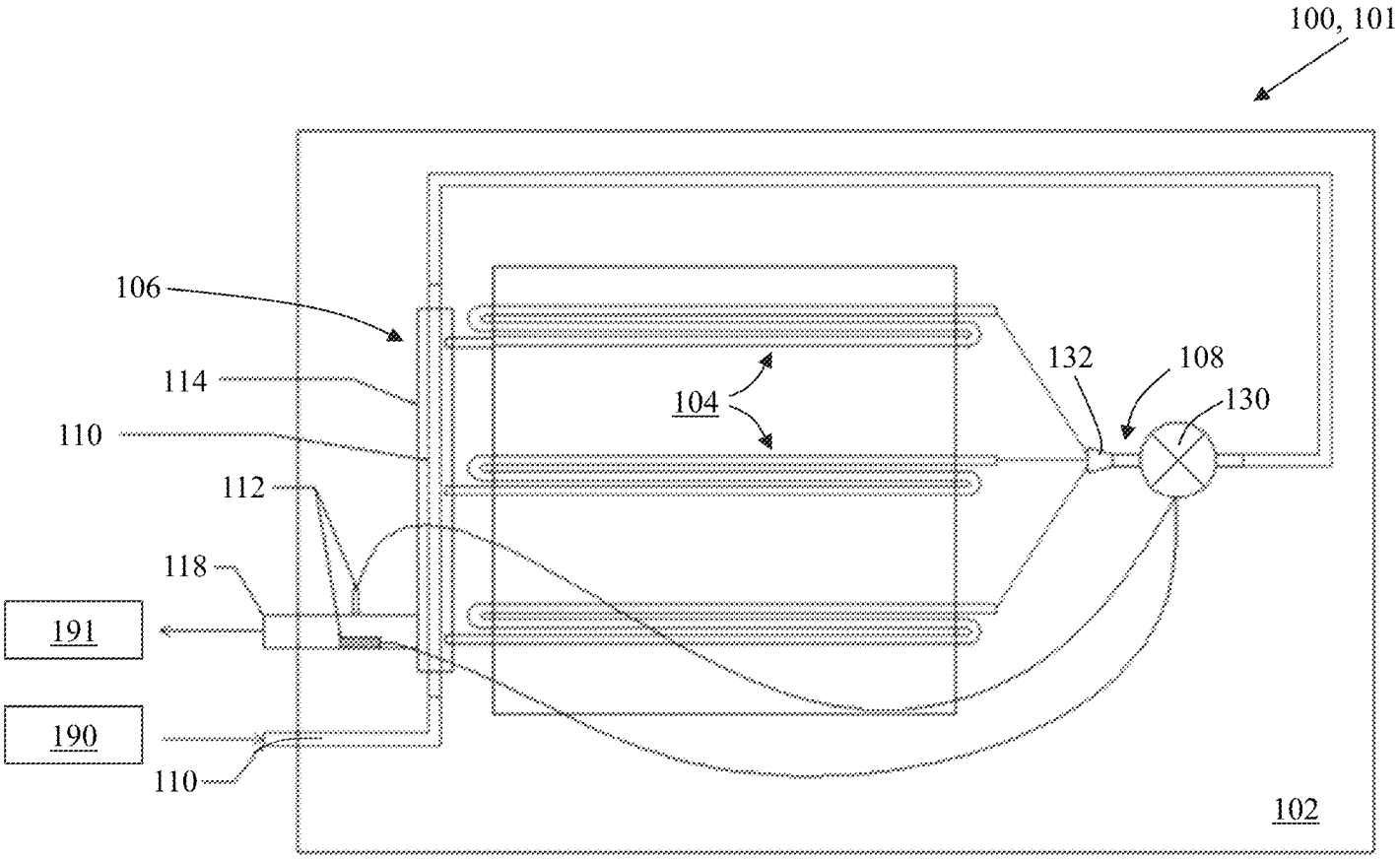
FIG. 1 illustrates a schematic diagram of an evaporator unit having an integral evaporator header liquid suction heat exchanger, in accordance with example embodiments of the present disclosure.
Figure 2:
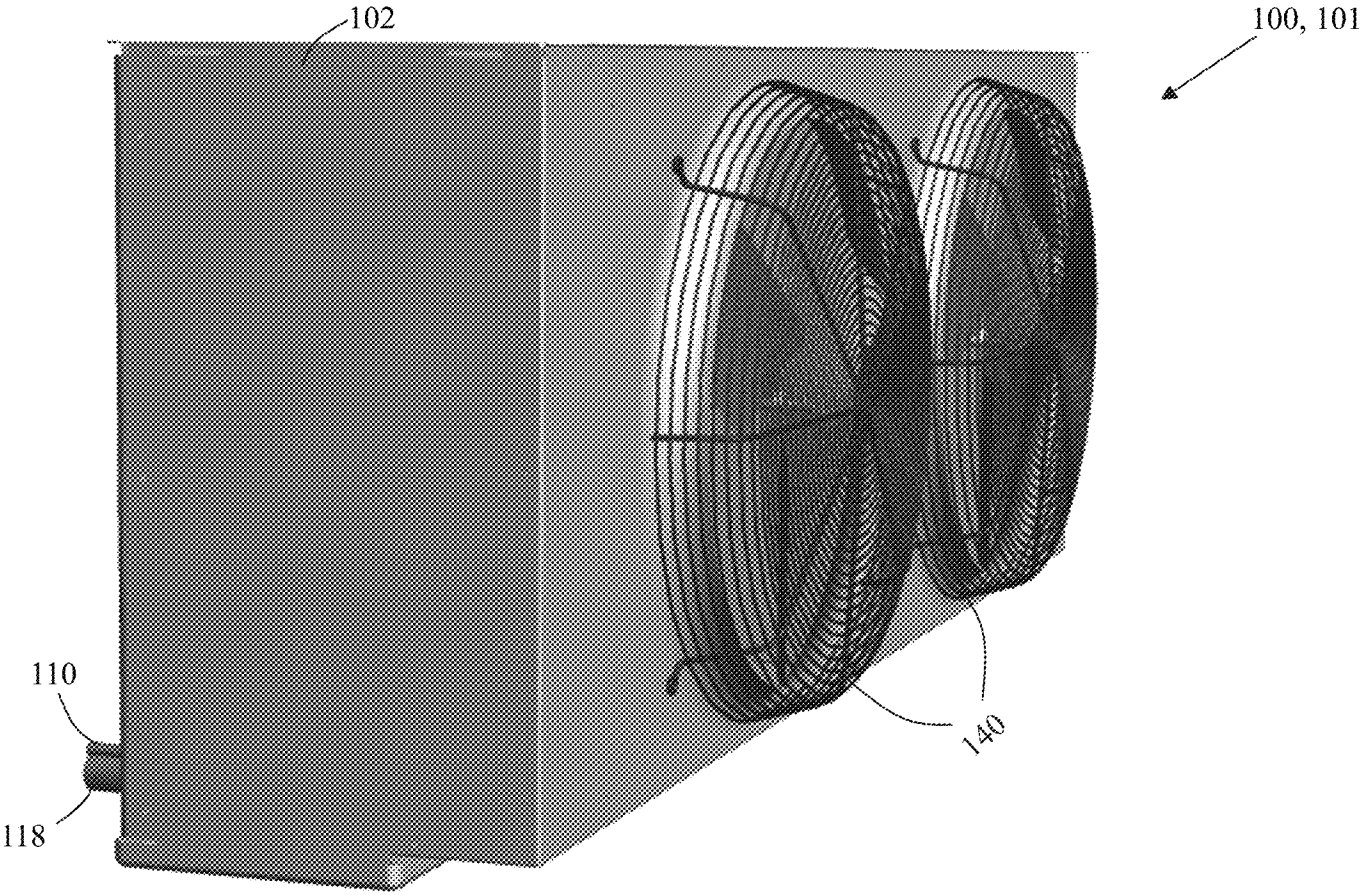
FIG. 2 illustrates a perspective view of the evaporator unit having the integral evaporator header liquid suction heat exchanger, in accordance with example embodiments of the present disclosure.

The drawings illustrate only example embodiments of the present disclosure and are therefore not to be considered limiting of its scope, as the present disclosure may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles.

DETAILED DESCRIPTION OF EXAMPLE EMBODIMENTS

The present disclosure describes an example direct expansion refrigeration system having an example integral evaporator header liquid suction heat exchanger. The example integral evaporator header liquid suction heat exchanger is fully assembled at the factory, compact, and entirely contained within the evaporator housing. The example integral evaporator header liquid suction heat exchanger includes: (a) an evaporator header to which the outlet ends of the evaporator coils are coupled, and (b) a liquid line from a condenser that is disposed in and passes through the evaporator header. The example integral evaporator header liquid suction heat exchanger is configured such that a refrigerant that enters the evaporator header from the evaporator coils is superheated by the liquid line passing through the evaporator header. That is, prior to entering the compressor, the refrigerant leaving the evaporator coils is superheated within the evaporator header by the hot liquid refrigerant in the liquid line that passes through the evaporator header.

Superheating the refrigerant within the evaporator header by running the liquid line from the condenser therethrough enables the refrigerant to be maintained in the two-phase state through the entire length of each of the evaporator coils, which in turn maximizes heat transfer and improves the efficiency and capacity of the refrigeration system. By converting the evaporator header of the refrigeration system into a liquid suction heat exchanger, the refrigeration system of the present disclosure is able to achieve higher evaporator efficiency and capacity (e.g., at least efficiency requirements set forth by regulatory bodies, such as USDOE, NRCan, etc., for the year 2020) without the additional cost of increasing the surface area of the evaporator coils, without spending additional power to drive the fan faster, and without having to expand or increase the footprint or size of the evaporator. In other words, for a given surface area of the evaporator coils, a given fan speed, and a given size of evaporator housing; the refrigeration system of the present disclosure that has the integral evaporator header liquid suction heat exchanger is able to achieve higher efficiency, heat transfer, and capacity than a conventional refrigeration system that does not have the integral evaporator header liquid suction heat exchanger.

Example embodiments of the direct expansion refrigeration system with the integral evaporator header liquid suction heat exchanger will be described more fully hereinafter with reference to the accompanying drawings that describe representative embodiments of the present technology. If a component of a figure is described but not expressly shown or labeled in that figure, the label used for a corresponding component in another figure can be inferred to that component. Conversely, if a component in a figure is labeled but not described, the description for such component can be substantially the same as the description for a corresponding component in another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

The technology of the integral evaporator header liquid suction heat exchanger of the present disclosure may be embodied in many different forms and should not be construed as limited to the embodiments set forth herein; rather, these embodiments are provided so that this disclosure will be thorough and complete, and will fully convey the scope of the technology to those appropriately skilled in the art. Further, example embodiments of the direct expansion refrigeration system of the present disclosure can be located in any type of environment (e.g., warehouse, attic, garage, storage, mechanical room, basement) for any type (e.g., commercial, residential, industrial) of user. Furthermore, even though the present disclosure describes the integral evaporator header liquid suction heat exchanger as being used in a direct expansion refrigeration system, one of skill in the art can understand and appreciate that an integral evaporator header liquid suction heat exchanger can be used in any appropriate system that employs a refrigeration cycle, such as a heating, ventilation, air-conditioning, and refrigeration (HVACR) system, without departing from a broader scope of the present disclosure.

Turning now to the figures, example embodiments of a direct expansion refrigeration system that has an example integral evaporator header liquid suction heat exchanger will be described in connection with FIGS. 1-10. Further, the performance improvements of the example direct expansion refrigeration system having the example integral evaporator header liquid suction heat exchanger in comparison to a conventional refrigeration system that does not have the integral evaporator header liquid suction heat exchanger will be illustrated and described in association with FIGS. 11-14. It is noted that FIGS. 1-14 and the following description of FIGS. 1-14 of the present disclosure are focused on an evaporator unit of the direct expansion refrigeration system. Other well-known components of the direct expansion refrigeration system, such as the compressor and the condenser unit have not been described in detail so as not to obscure the subject matter of the integral evaporator header liquid suction heat exchanger.

Referring to FIGS. 1-10, an example direct expansion refrigeration system 100 (herein 'refrigeration system') of the present disclosure may include an evaporator unit 101

(herein 'evaporator'). The evaporator 101 may include a housing 102 that houses an evaporator coil heat exchanger 104 (herein 'evaporator coils'), an integral evaporator header liquid suction heat exchanger 106 (herein 'integral suction heat exchanger'), and an expansion valve and distributer assembly 108. Further, the housing 102 may accommodate at least a portion of a liquid line 110 that extends from a condenser unit 190 of the refrigeration system to the expansion valve and distributer assembly 108, a suction line connector 118 that may be coupled to a suction line that extends from the evaporator 101 to a compressor 191 of the refrigeration system 100, and sensor elements 112 that are coupled to the suction line connector 118.

Figure 8:
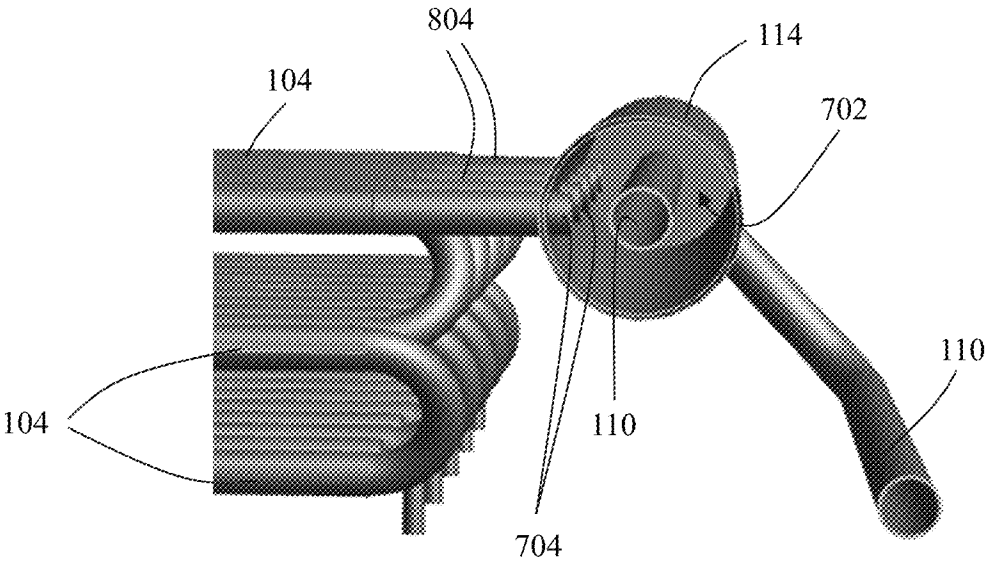
FIG. 8 illustrates a cross sectional view of the integral evaporator header liquid suction heat exchanger along the Y-Y' plane shown in FIG. 5, in accordance with example embodiments of the present disclosure.

The integral suction heat exchanger 106 may include an evaporator header 114 and a portion of the liquid line 110 that extends through the evaporator header such that they define an integral tube-in-tube heat exchanger structure. The evaporator header 114 may also be interchangeably referred to as a suction header. The evaporator header 114 may be a common receptacle that is configured to receive the refrigerant from the evaporator coils 104. As such, the outlet ends of each of the evaporator coils 104 may be coupled to evaporator header 114. As illustrated in FIG. 8, the evaporator coils 104 may be coupled to the evaporator header 114 using adaptor tubes 804. Further, the evaporator header 114 may include a suction line connector 118 that couples the suction line of the refrigeration system 100 to the evaporator header 114. Furthermore, as described above, a portion of the liquid line 110 from the condenser unit may extend through the evaporator header 114.

Figure 9:
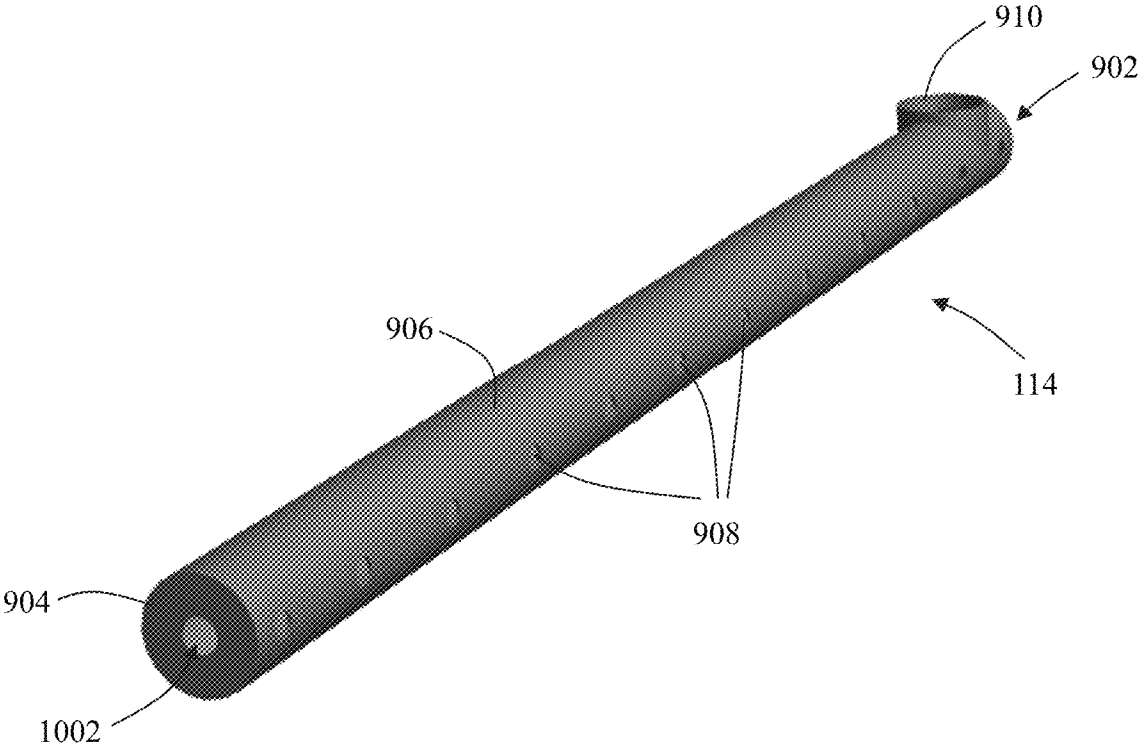
FIGS. 9-10 illustrate different perspective views of an evaporator header of the the integral evaporator header liquid suction heat exchanger, in accordance with example embodiments of the present disclosure.
Figure 10:
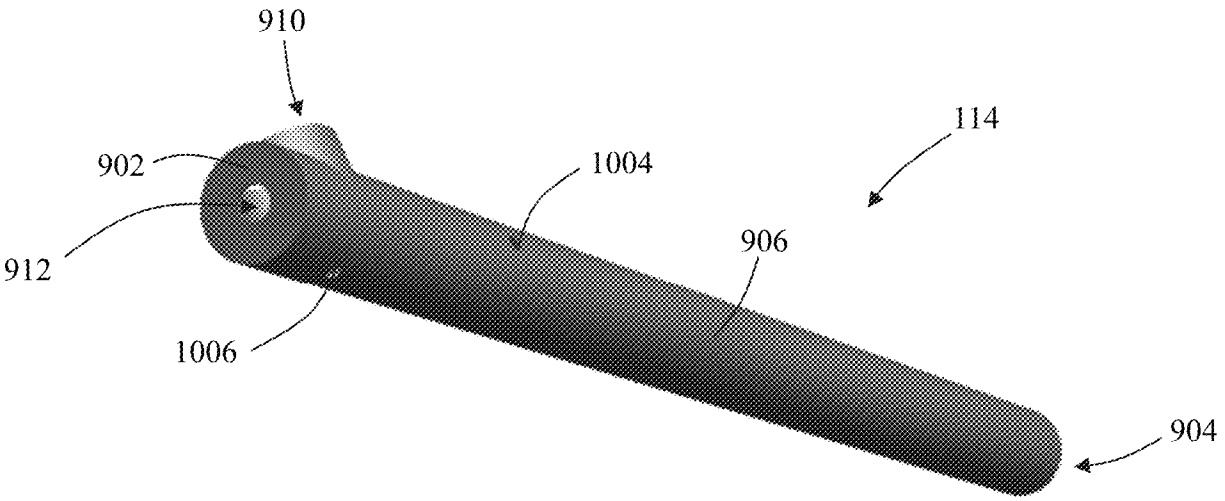
Figure 11:
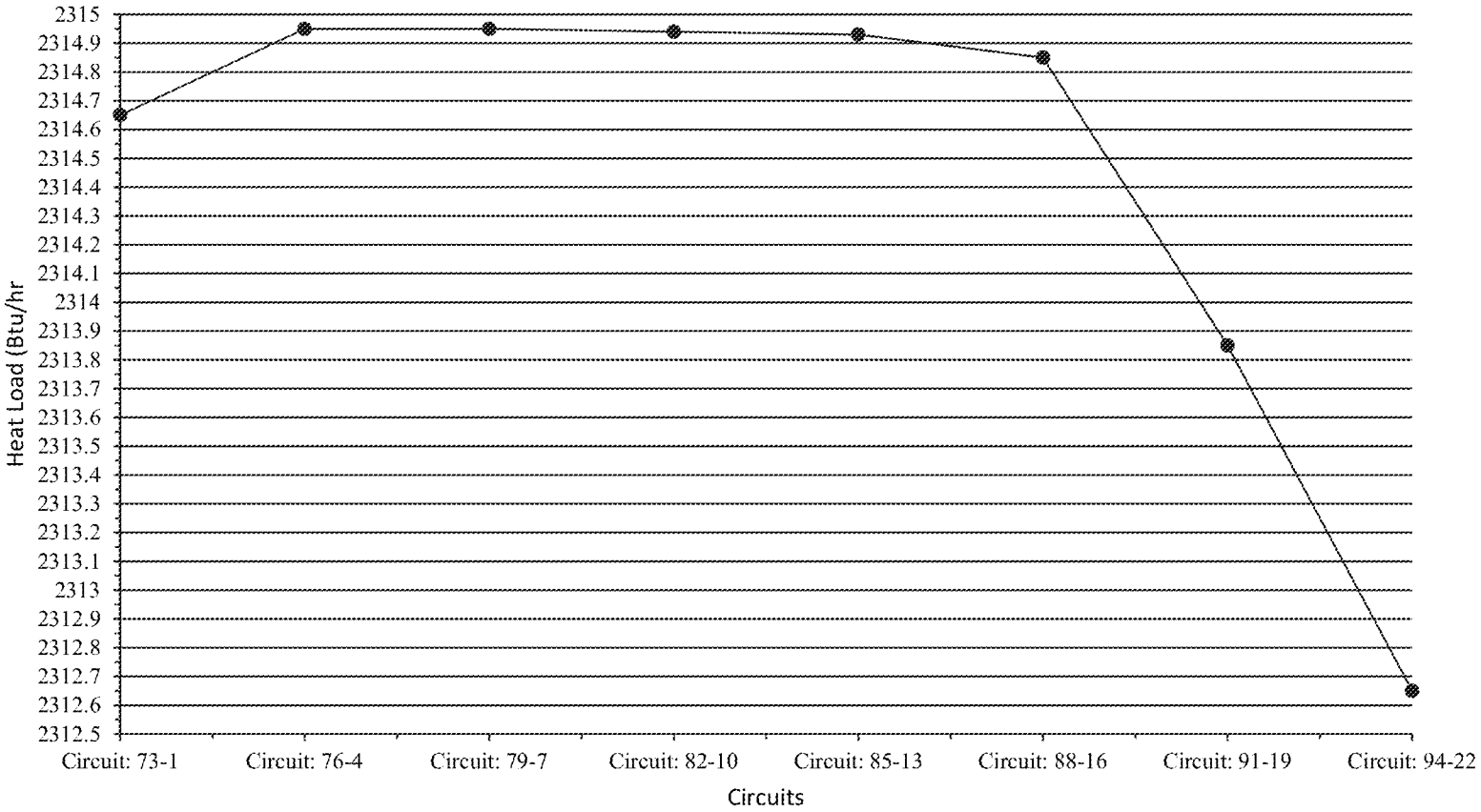
FIG. 11 (Prior Art)
FIG. 11 is a graph that illustrates heat load transfer per evaporator coil circuit of the evaporator coil heat exchanger, in accordance with a prior art refrigeration system.
Figure 12:
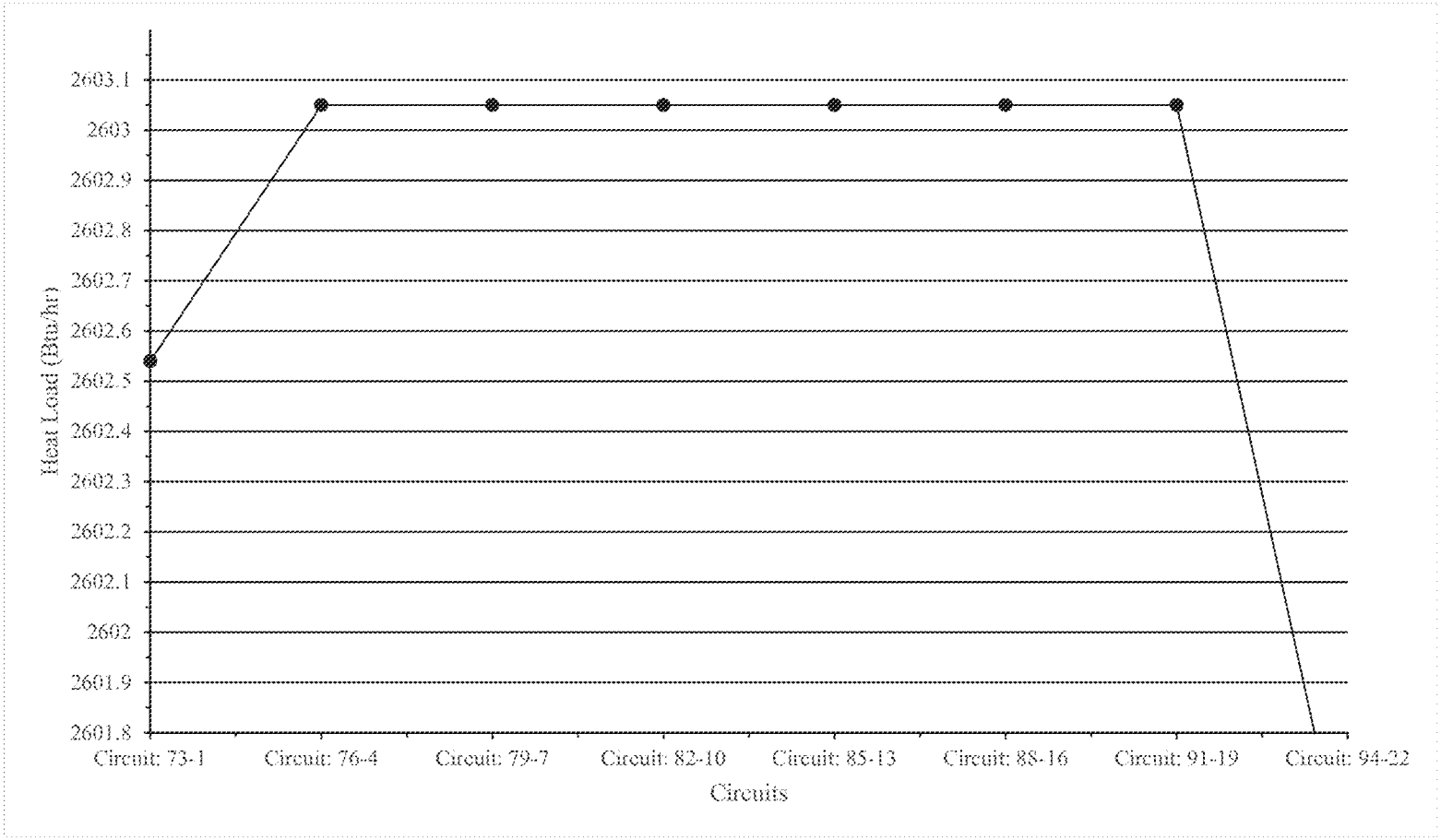
FIG. 12 is a graph that illustrates heat load transfer per evaporator coil circuit of the evaporator coil heat exchanger of the evaporator unit having the integral evaporator header liquid suction heat exchanger, in accordance with example embodiments of the present disclosure.
Figure 13:
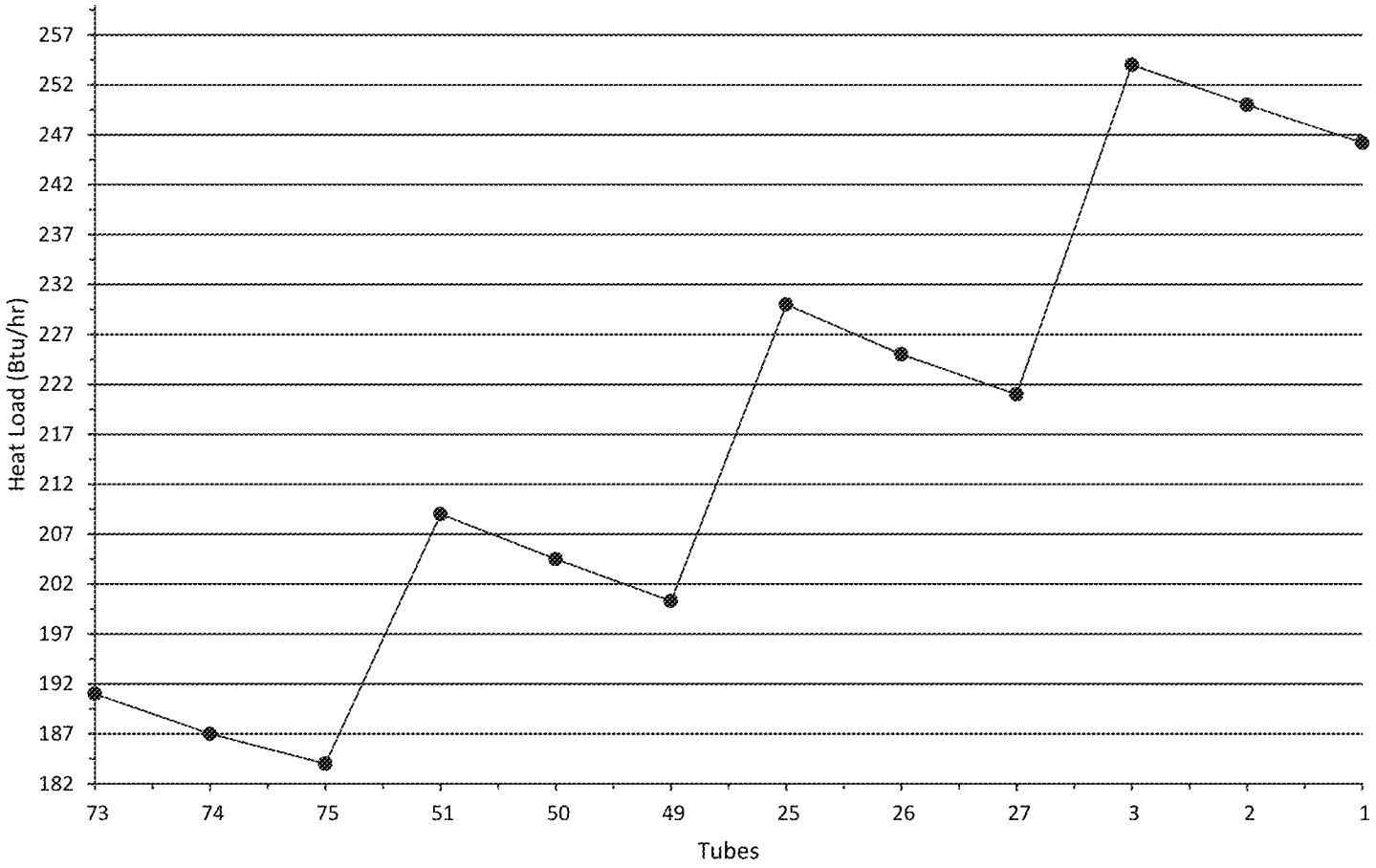
FIG. 13 (Prior Art)
FIG. 13 is a graph that illustrates heat load transfer per tube of an evaporator coil circuit of the evaporator coil heat exchanger, in accordance with a prior art refrigeration system.
Figure 14:
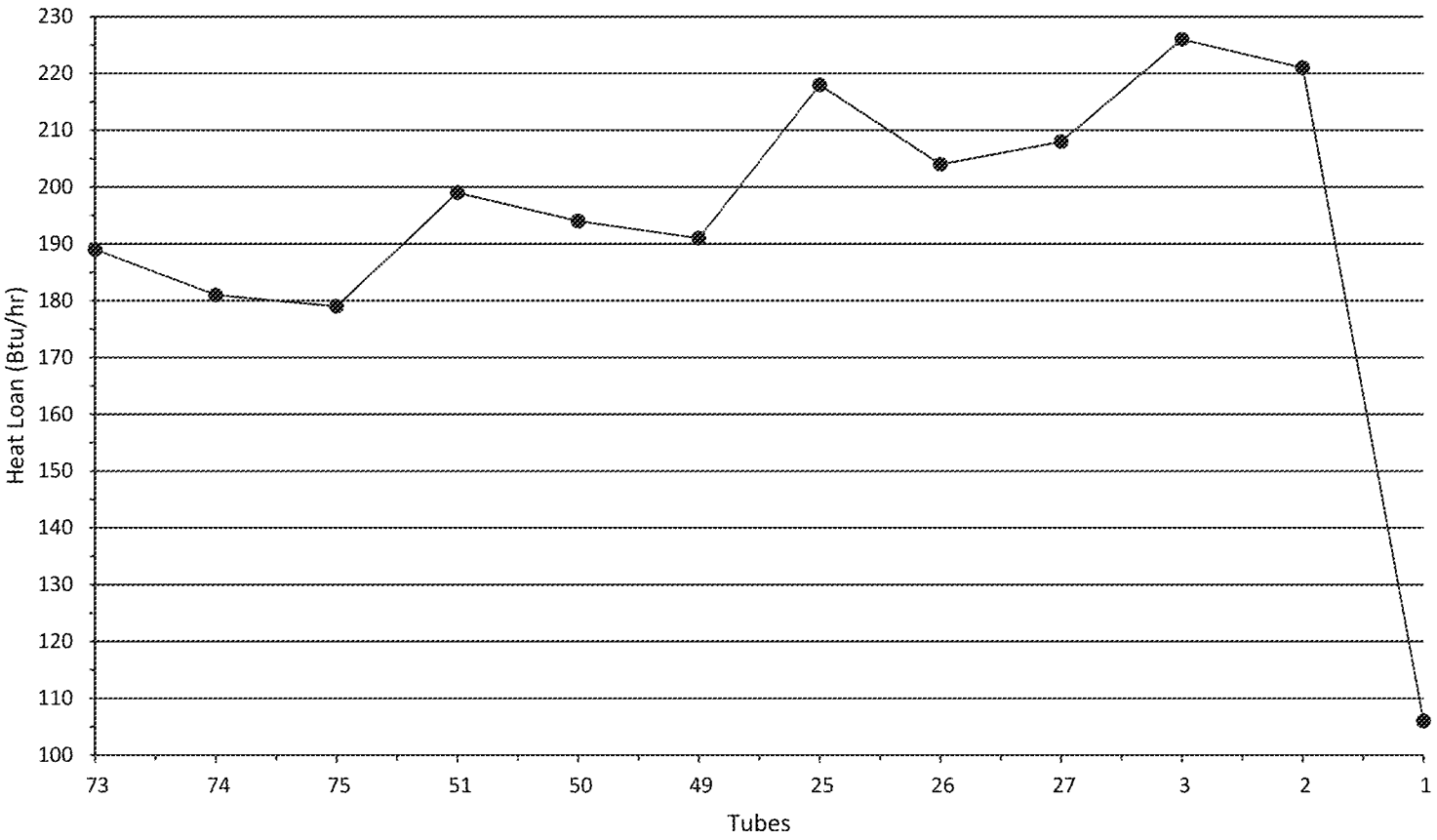
FIG. 14 is a graph that illustrates heat load transfer per tube of an evaporator coil circuit of the evaporator coil heat exchanger of the evaporator unit having the integral evaporator header liquid suction heat exchanger, in accordance with example embodiments of the present disclosure.

As illustrated in FIGS. 9-10, in one example embodiment, the evaporator header 114 may be substantially cylindrical in shape. In particular, the evaporator header 114 may include a top wall 902, a bottom wall 904, and a side wall 906 that collectively define a hollow inner cavity 702 (shown in FIGS. 7 and 8) that is substantially cylindrical in shape. The side wall 906 of the evaporator header 114 may include a plurality of inlet openings 908, a suction line outlet opening 910, a valve outlet opening 1004, and an equalizer line opening 1006 formed therein. Each of the openings (908, 910, 1004, and 1006) may be through openings that extend through the side wall 906.

Figure 3:
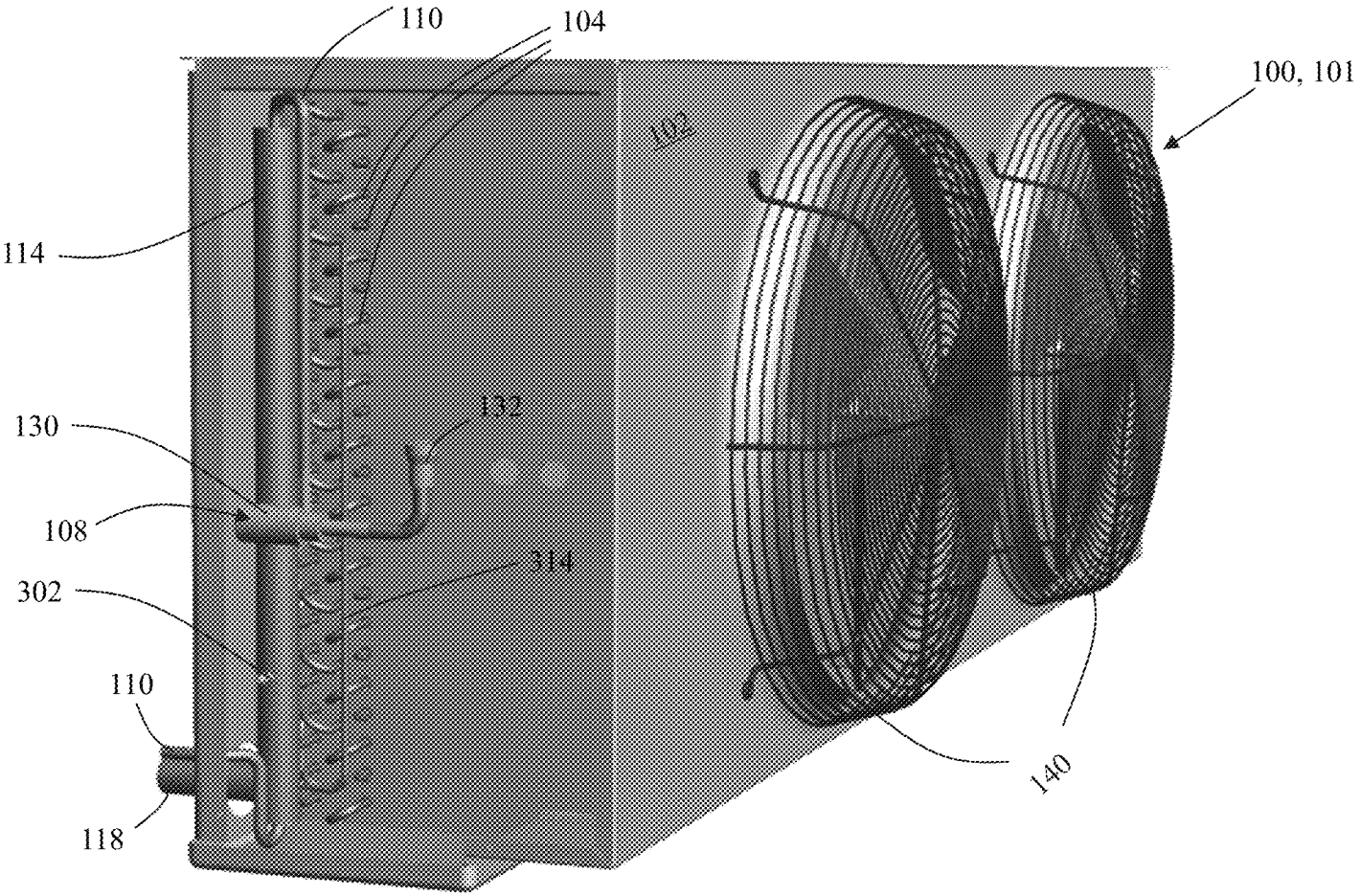
FIG. 3 illustrates the perspective view of the evaporator unit of FIG. 1 with a portion of the evaporator unit housing having been removed to display the integral evaporator header liquid suction heat exchanger, in accordance with example embodiments of the present disclosure.
Figure 4:
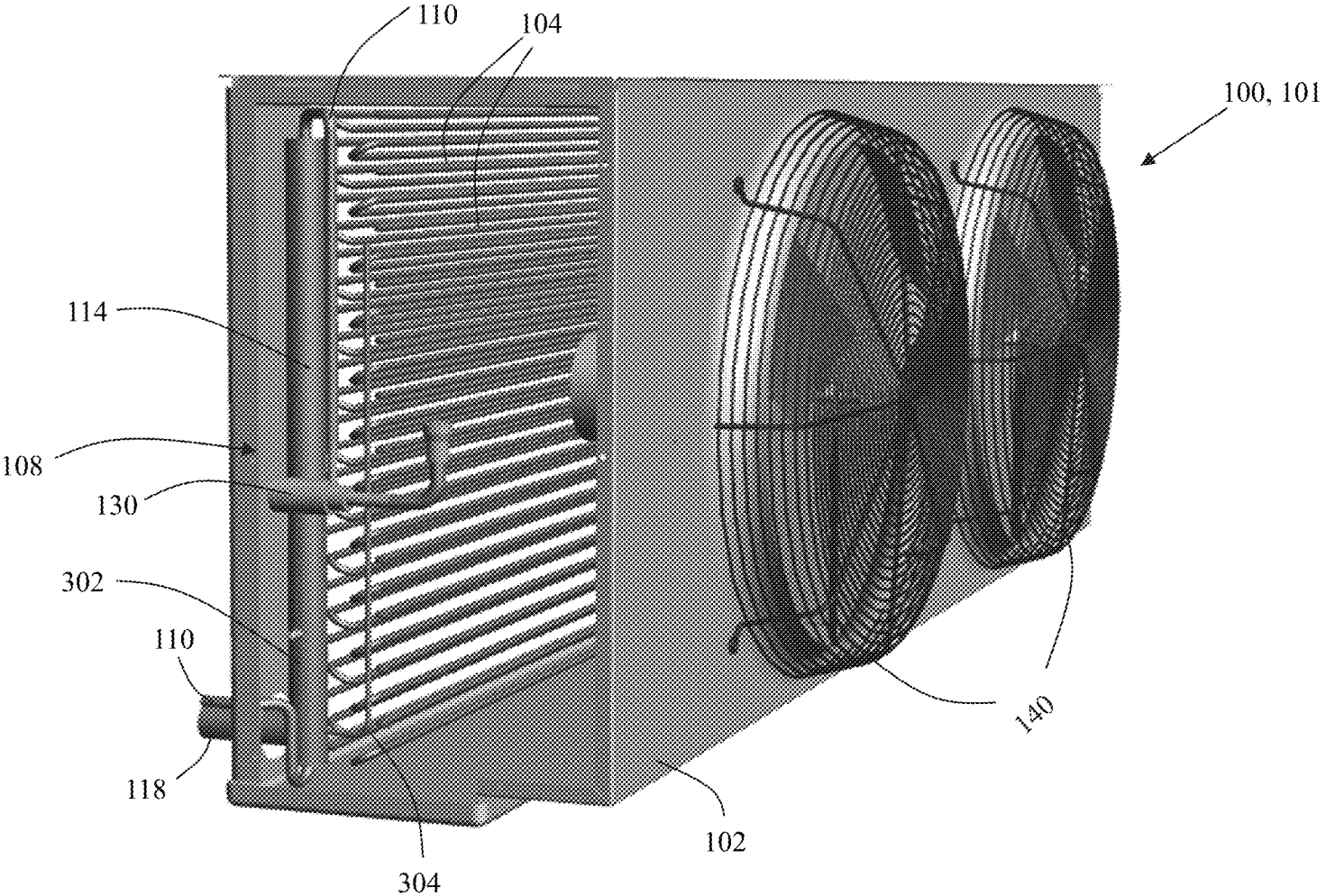
FIG. 4 illustrates the perspective view of the evaporator unit of FIG. 1 with another portion of the evaporator unit housing having been removed to display the integral evaporator header liquid suction heat exchanger and the evaporator coil heat exchanger, in accordance with example embodiments of the present disclosure.
Figure 5:
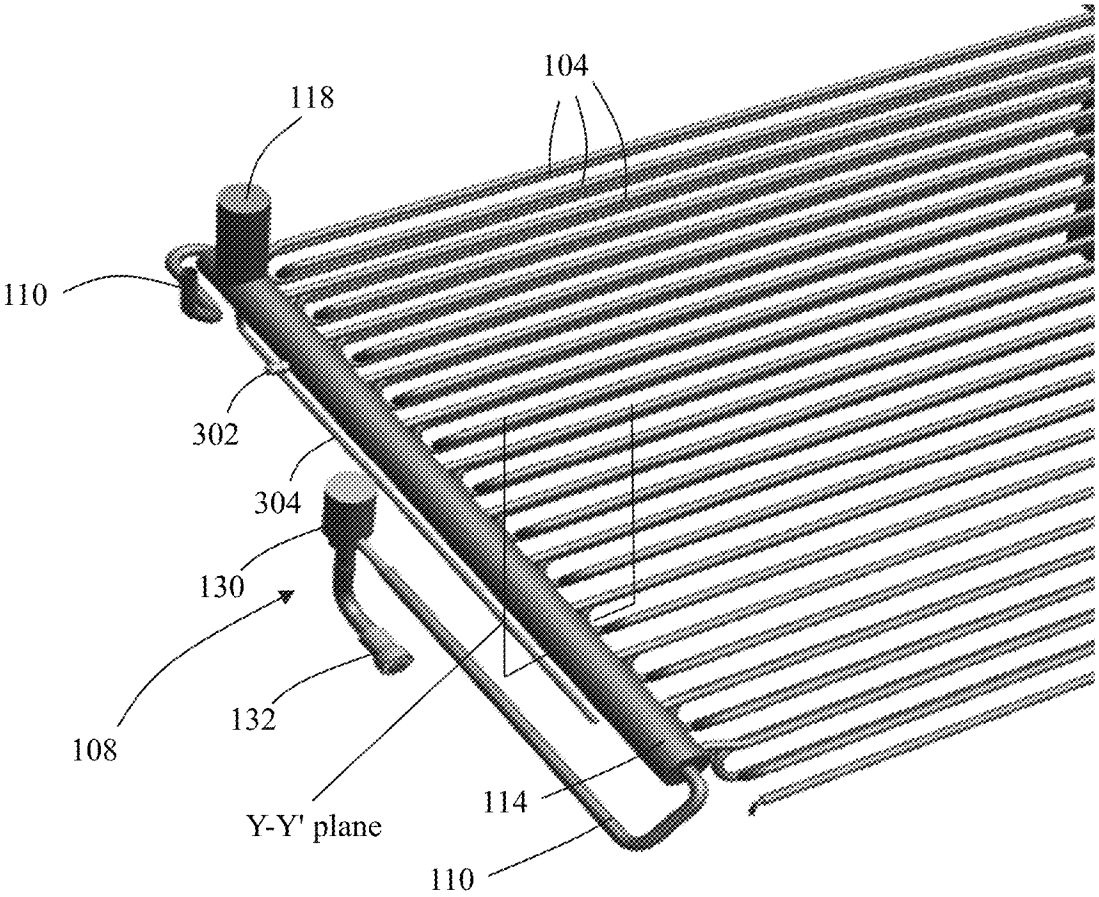
FIGS. 5-6 illustrate different perspective views of the integral evaporator header liquid suction heat exchanger with the evaporator coil heat exchanger coupled thereto, in accordance with example embodiments of the present disclosure.
Figure 6:
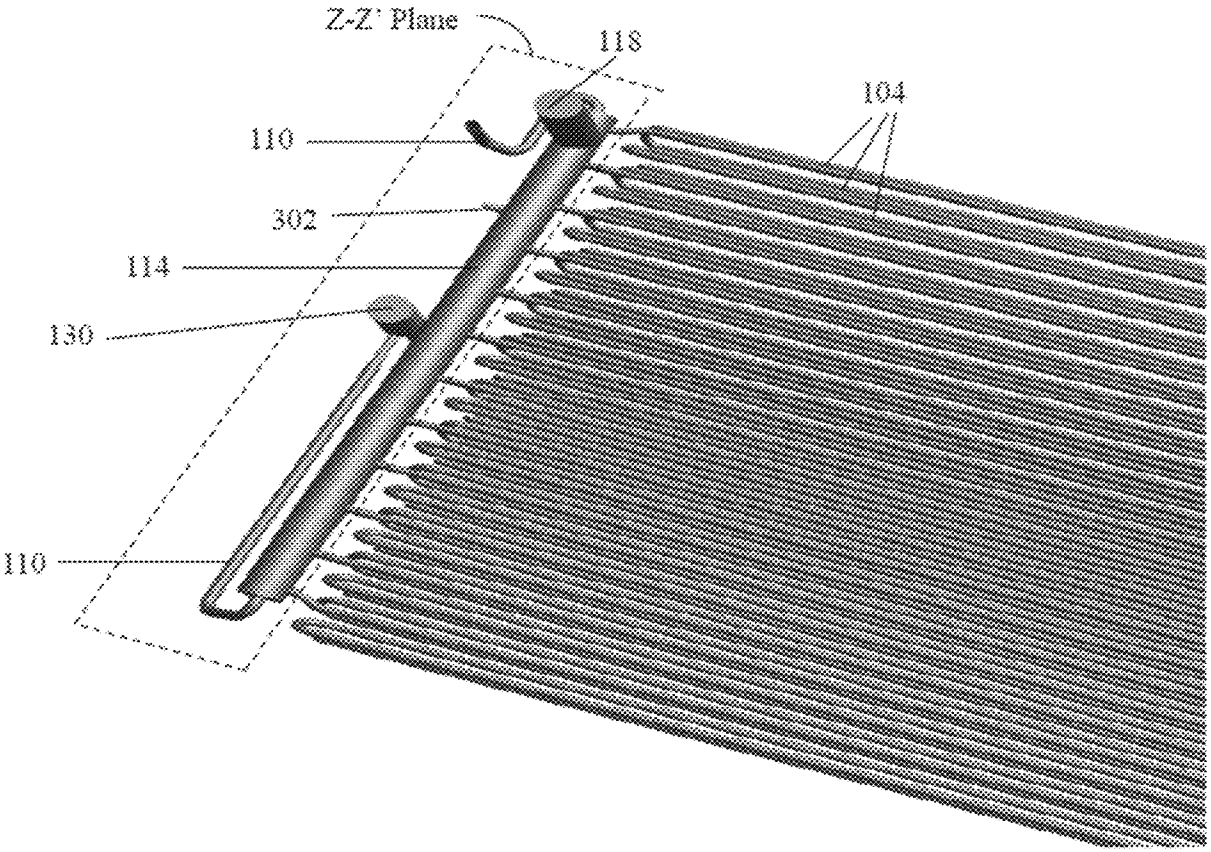
Figure 7:
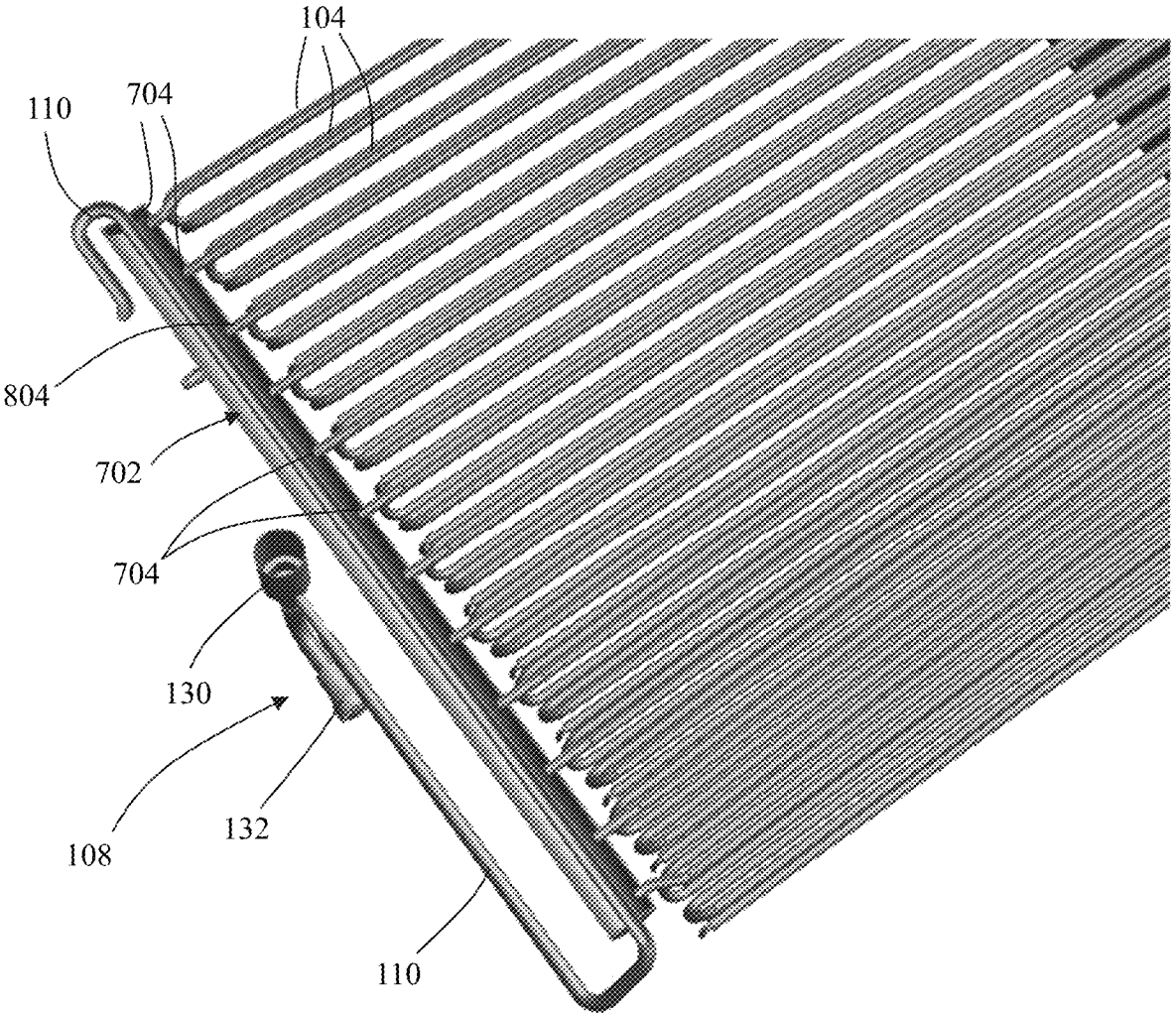
FIG. 7 illustrates a cross sectional view of the integral evaporator header liquid suction heat exchanger along the Z-Z' plane shown in FIG. 6, in accordance with example embodiments of the present disclosure.

The plurality of inlet openings 908 may be configured to receive the outlet ends 704 of the adaptor tubes 804 as illustrated in FIGS. 7-8 and thereby couple the evaporator coils 104 to the evaporator header 114. The suction line outlet opening 910 may be configured receive and couple the suction line connector 118 to the evaporator header 114 as illustrated in FIGS. 5 and 6. Similarly, the valve outlet opening 1004 and an equalizer line opening 1006 may be configured to couple a service access valve 302 and an external equalizer line 304 to the evaporator header 114, respectively, as illustrated in FIGS. 3-5. The service access valve 302 may be configured to read pressure during service or installation of the refrigeration system 100, while the external equalizer line 304 may be configured to be coupled to a mechanical (thermostatic) expansion valve to provide pressure in the suction line to a mechanical expansion valve for accurate superheat adjustment. The expansion valve 130 illustrated in FIGS. 1-10 is an electronic expansion valve. However, in other example embodiments, the electronic expansion valve may be replaced with a mechanical or thermostatic expansion valve without departing from a broader scope of the present disclosure.

In addition to the openings (908, 910, 1004, and 1006) formed in the side wall 906 of the evaporator header 114, both the top wall 902 and the bottom wall 904 of the evaporator header 114 may include liquid line openings 912 and 1002 formed therein to allow the liquid line 110 to pass therethrough such that at least a portion of the liquid line 110 is disposed in and extends through hollow inner cavity 702 of the evaporator header 114. In particular, the liquid line 110 enters the hollow inner cavity 702 defined by the evaporator header 114 through the liquid line opening 912 formed in the top wall 902 and exits the hollow inner cavity 702 through the liquid line opening 1002 formed in the bottom wall 904 of the evaporator header 114. As illustrated in the cross-section views of the integral suction heat exchanger 106 in FIGS. 7-8, the diameter of the liquid line 110 may be lesser than the diameter of the evaporator header 114. The inlet end of the liquid line 110 may be coupled to the condenser unit 190 of the refrigeration system 100 and may be configured to route hot condensate refrigerant in a liquid state (herein 'hot condensate liquid refrigerant') from the condenser unit to the expansion valve 112.

During operation, the liquid line 110 may feed the hot condensate liquid refrigerant from the condenser unit 190 to the expansion valve 130 of the expansion valve and distributor assembly 108. The expansion valve 130 controls the flow of the hot condensate liquid refrigerant to the evaporator coils 104. In particular, the hot condensate liquid refrigerant that is at a high pressure experiences a pressure drop as it passes through the expansion valve 130 and is converted to a two-phase state where the refrigerant exists as a mixture of liquid state and vapor state. The low pressure refrigerant that is in the two-phase state (herein 'two-phase refrigerant') is fed to the evaporator coils 104 by the distributer 132 of the expansion valve and distributer assembly 108. The refrigerant that passes through the evaporator coils 104 draws heat from the air that the evaporator fans 140 blow across the evaporator coils 104, thereby causing the air blowing across the evaporator coils 104 to condition (e.g., cool) a temperature and/or a humidity of a space serviced by the refrigeration system 100. The adaptor tubes 804 coupled to the evaporator coils 104 channel the refrigerant from the evaporator coils 104 over a hot surface of the portion of the liquid line 110 that is disposed in the hollow inner cavity 702 of the evaporator header 114 of the integral suction heat exchanger 106. Upon contact with the hot surface of the liquid line 110, the refrigerant from the evaporator coils 104 changes to a vapor state (herein 'vaporized refrigerant'). That is, the integral suction heat exchanger 106 uses the hot condensate liquid refrigerant in the liquid line 110 to superheat and convert the refrigerant from the evaporator coils 104 to a vaporized refrigerant within the evaporator header 114. Further, the vaporized refrigerant returns to the compressor via the suction line to restart the cycle.

Since the refrigerant from the evaporator coils 104 is superheated and converted to a vaporized refrigerant within the evaporator header 114, the sensor elements 112 that measure the temperature and pressure of the superheated refrigerant may be coupled to the suction line connector 118 at the outlet of the evaporator header 114. The temperature and pressure of the superheated refrigerant that is measured by the sensor elements 112 may be provided as feedback to the expansion valve 130 to control the flow of the refrigerant into the evaporator coils 104. Further, superheating the refrigerant within the evaporator header 114 enables the refrigerant in the evaporator coils 104 to be maintained in the two-phase state through the entire length of each of the evaporator coils, which in turn maximizes air to refrigerant heat transfer and improves the efficiency and capacity of the refrigeration system 100.

Unlike conventional refrigeration systems that do not include the integral suction heat exchanger 106 and therefore have to maintain the refrigerant in a vapor state through a substantial length of the evaporator coils 104, the evaporator coils 104 of the refrigeration system 100 of the present disclosure that includes the integral suction heat exchanger 106 may have a higher evaporator heat load transfer because the refrigerant is maintained in the two-phase state through the entire length of each of the evaporator coils. For example, as illustrated in FIGS. 11-12 and 13-14, the heat load transfer per evaporator coil circuit and per tube of each evaporator coil circuit of the evaporator coils 104 of the refrigeration system 100 with the integral suction heat exchanger 106 is higher than the heat load transfer per evaporator coil circuit and per tube of each evaporator coil circuit of the evaporator coils 104 of the conventional refrigeration system. It is noted that the increase in the heat load transfer per evaporator coil circuit and per tube of each evaporator coil circuit of the evaporator coils 104 in the refrigeration system 100 with the integral suction heat exchanger 106 results in a 5-20% increase in the total heat load of the refrigeration system 100 with the integral suction heat exchanger 106 when compared to the conventional refrigeration system.

In addition to superheating the two-phase refrigerant from the evaporator coils 104, the hot condensate liquid refrigerant is also subcooled within the evaporator header 114 of the integral suction heat exchanger 106. The hot condensate liquid refrigerant is subcooled by transferring the heat from the hot condensate liquid refrigerant to the two-phase refrigerant from the evaporator coils 104 to superheat and convert the two-phase refrigerant from the evaporator coils 104 to a vaporized refrigerant.

Further, using the evaporator header 114 to form the liquid suction heat exchanger allows the evaporator to be compact and to be designed with minimal additional cost. Further, the integral suction heat exchanger 106 is entirely contained within the evaporator housing 102 and is factory assembled, thereby eliminating the need to hire labor for installation of the liquid suction heat exchanger. In other words, the integral suction heat exchanger 106 increases the efficiency and capacity of the evaporator 101. with minimal additional cost and without increasing the size or footprint of the evaporator 101 (resulting from increasing evaporator coil surface area or size of fan). In one example, the efficiency and capacity of the refrigeration system 100 with the integral suction heat exchanger 102 may meet the efficiency requirements set forth by the USDOE (U.S. Department of Energy) for the year 2020.

Even though the present disclosure describes the evaporator header as being substantially cylindrical and defining a substantially cylindrical hollow inner cavity, one of skill in the art can understand and appreciate that in other example embodiments, the evaporator header can have any other appropriate shape and can define an inner cavity having any other appropriate shape without departing from a broader scope of the present disclosure. Further, one of skill in the art can understand and appreciate that in other example embodiments, the evaporator header 114 may include fewer or more openings without departing from a broader scope of the present disclosure. For example, in some embodiments, the evaporator header 114 may not include the equalizer line opening 1006 and the external equalizer line 304 coupled thereto. Furthermore, even though FIGS. 1, 7, and 8, illustrate the liquid line 110 making a single pass through the evaporator header 114, one of skill in the art can understand and appreciate that in other example embodiments, the liquid line 110 may make multiple passes through the evaporator header 114 prior to being coupled to the expansion valve at the outlet end. That is, the integral suction heat exchanger 106 may include multiple passes of liquid line 110. Additionally, it is noted that the term 'line' as used herein may generally refer to a tube or pipe, e.g., pipe carrying refrigerant in the refrigerant system.

Figure 15:
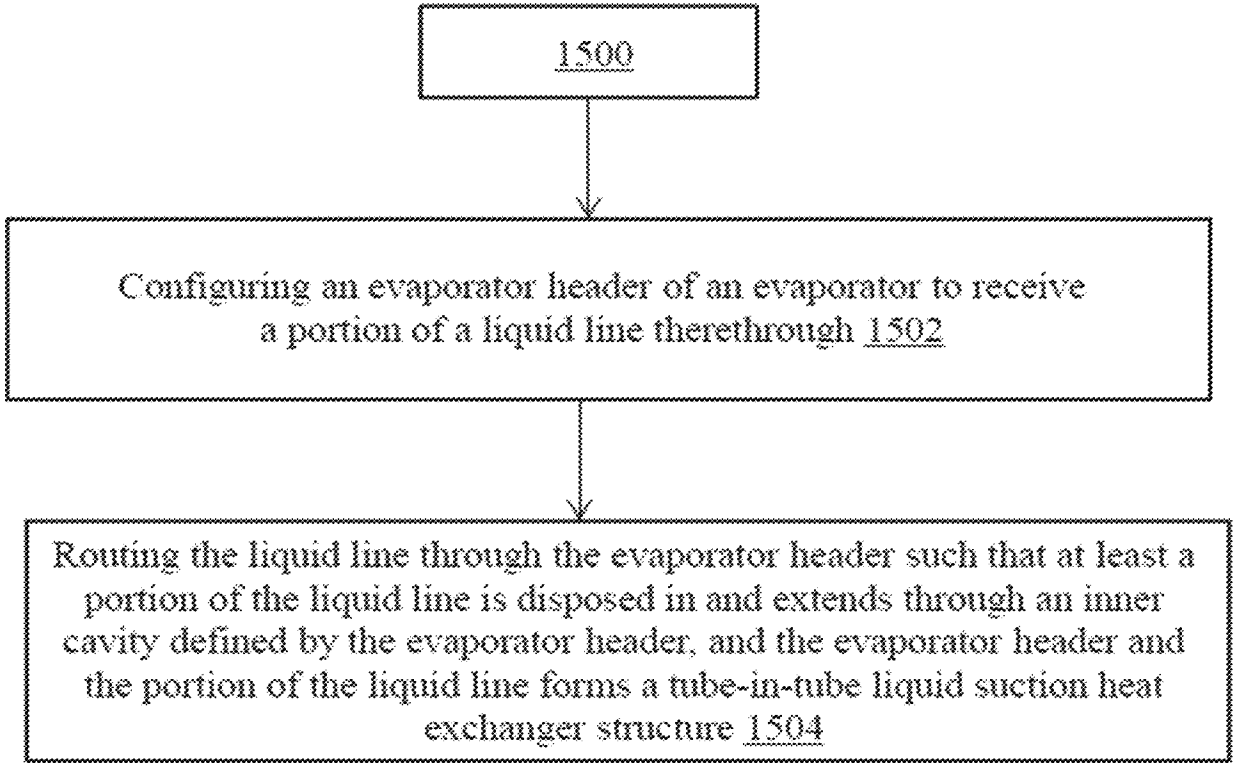
FIG. 15 is a flowchart that illustrates an example method associated with the integral evaporator header liquid suction heat exchanger, in accordance with example embodiments of the present disclosure.

Referring to FIG. 15, a method of manufacturing integral suction heat exchanger of the present disclosure includes operation 1502 where the evaporator header 114 of the evaporator 101 is configured to receive a portion of a liquid line 110 therethrough. The evaporator header 114 may define an inner cavity 702 that is configured to receive refrigerant from evaporator coils 104 of the evaporator 101. The operation 1502 of configuring the evaporator header 114 may include forming a liquid line inlet opening 912 and a liquid line outlet opening 1002 through which the liquid line 110 can enter and exit the inner cavity 702 of the evaporator header 114 such that at least a portion of the liquid line 110 is disposed in the evaporator header and configured to superheat and convert refrigerant from the evaporator coils 104 to a vapor state prior to being routed to the compressor 191. Further, the method includes operation 1504 where the liquid line 110 is routed through the evaporator header 114 such that at least the portion of the liquid line 110 is disposed in and extends through the inner cavity 702 defined by the evaporator header 114 such that the evaporator header and the portion of the liquid line forms a tube-in-tube liquid suction heat exchanger structure. It is noted that the refrigerant flowing through the liquid line 110 and the refrigerant entering the evaporator header 114 from the evaporator coils 104 are the same refrigerant, but at different states or phases (e.g., liquid, vapor, or two-phase that is a combination of liquid and vapor) and at different temperatures.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. An evaporator of a refrigeration system comprising:

an integral liquid suction heat exchanger including:

an evaporator header including (i) a top wall comprising a liquid line inlet opening formed therein, (ii) a bottom wall disposed opposite the top wall and comprising a liquid line outlet opening formed therein, and (iii) a side wall extending from the top wall to the bottom wall, the side wall compromising a plurality of inlet openings and a suction line outlet opening, the top wall, the bottom wall, and the side wall defining an inner cavity, the evaporator header being configured to receive a refrigerant from evaporator coils of the evaporator; and a portion of a liquid line that extends through the inner cavity defined by the evaporator header such that:

the evaporator header and the portion of the liquid line form a tube-in-tube structure, the refrigerant from the evaporator coils is superheated and converted to a vapor state in the evaporator header by heat from the refrigerant flowing through the liquid line, wherein the liquid line is configured to route the refrigerant from a condenser to an expansion valve of the refrigeration system.

2. The evaporator of claim 1, wherein the integral liquid suction heat exchanger is disposed in an evaporator housing.

3. The evaporator of claim 1, wherein the evaporator coils are coupled to the evaporator header via adaptor tubes that are configured to channel the refrigerant from the evaporator coils to the inner cavity of the evaporator header.

4. The evaporator of claim 3, wherein the refrigerant that is channeled from the evaporator coils to the evaporator header is in a two-phase state that is a mixture of a liquid state and the vapor state.

5. The evaporator of claim 1, wherein the refrigerant flowing through the liquid line is in a liquid state and has a temperature that is higher than that of the refrigerant from the evaporator coils.

6. The evaporator of claim 1, wherein the refrigerant flowing through the liquid line is subcooled by heat transfer from the refrigerant flowing through the liquid line to the refrigerant from the evaporator coils.

7. The evaporator of claim 1, wherein the evaporator header is substantially cylindrical in shape and the inner cavity is substantially cylindrical in shape.

8. The evaporator of claim 7, wherein a diameter of the evaporator header is larger than a diameter of the portion of the liquid line extending therethrough.

9. The evaporator of claim 1, wherein the liquid line from the condenser enters the inner cavity of the evaporator header through the liquid line inlet opening in the top wall of the evaporator header and exits the inner cavity to the expansion valve through the liquid line outlet opening in the bottom wall of the evaporator header.

10. The evaporator of claim 1, wherein the plurality of inlet openings formed in the side wall of the evaporator header receive outlet ends of adaptor tubes that are configured to channel the refrigerant from the evaporator coils over the portion of the liquid line in the evaporator header, and wherein the suction line outlet opening couples a suction line to the evaporator header via a suction line connector.

11. A refrigeration system comprising:

an evaporator comprising:

a housing that comprises:

an expansion valve;

evaporator coils that are coupled to an outlet of the expansion valve and configured to route refrigerant from the expansion valve to a compressor of the refrigeration system, the compressor being disposed external to the housing of the evaporator and coupled to the evaporator via a suction line; and a liquid suction heat exchanger that is coupled to an outlet of the evaporator coils and configured to superheat and convert the refrigerant from the evaporator coils to a vapor state using the refrigerant from a condenser of the refrigeration system, the condenser being disposed external to the housing of the evaporator and coupled to the evaporator via a liquid line, the liquid suction heat exchanger comprising:

an evaporator header including (i) a top wall comprising a liquid line inlet opening formed therein, (ii) a bottom wall disposed opposite the top wall and comprising a liquid line outlet opening formed therein, and (iii) a side wall that extends from the top wall to the bottom wall, the side wall comprising a plurality of inlet openings and a suction line outlet opening, the top wall, bottom wall, and side wall defining an inner cavity, the evaporator header being configured to receive the refrigerant from the evaporator coils therein.

12. The refrigeration system of claim 11, wherein the liquid suction heat exchanger that is disposed in the housing of the evaporator further comprises:

a portion of the liquid line that extends through the inner cavity defined by evaporator header such that:

the evaporator header and the portion of the liquid line form a tube-in-tube structure, and the refrigerant from the evaporator coils is superheated and converted to a vapor state in the evaporator header by heat from the refrigerant flowing through the liquid line, wherein the liquid line is configured to route the refrigerant from the condenser to the expansion valve.

13. The refrigeration system of claim 11, wherein the refrigerant that is received in the inner cavity of the evaporator header from the evaporator coils is in a two-phase state that is a mixture of a liquid state and the vapor state, while the refrigerant from the condenser that flows through the liquid line is in the liquid state and has a higher temperature than the refrigerant from the evaporator coils, and wherein the refrigerant from the evaporator coils and the refrigerant from the condenser are the same refrigerant.

14. The refrigeration system of claim 11, wherein the liquid line from the condenser enters the inner cavity of the evaporator header through the liquid line inlet opening in the top wall of the evaporator header and exits the inner cavity to the expansion valve through the liquid line outlet opening in the bottom wall of the evaporator header.

15. The refrigeration system of claim 11, wherein the plurality of inlet openings formed in the side wall of the evaporator header are configured to receive outlet ends of adaptor tubes that are configured to channel the refrigerant from the evaporator coils over the portion of the liquid line in the evaporator header, and wherein the suction line outlet opening is configured to couple the suction line to the evaporator header via a suction line connector.

16. A method comprising:

providing an evaporator header of an evaporator, the evaporator header including (i) a top wall comprising a liquid line inlet opening formed therein, (ii) a bottom wall disposed opposite the top wall and comprising a liquid line outlet opening formed therein, and (iii) a side wall that extends from the top wall to the bottom wall, the side wall comprising a plurality of inlet openings and a suction line outlet opening, the top wall, bottom wall, and side wall defining an inner cavity, the evaporator header being configured to receive refrigerant from evaporator coils of the evaporator;

configuring the inner cavity of the evaporator header to receive a portion of a liquid line therethrough; and routing the liquid line through the evaporator header such that: (a) at least a portion of the liquid line is disposed in and extends through the inner cavity defined by the evaporator header, and (b) the evaporator header and the portion of the liquid line form a liquid suction heat exchanger, the liquid line coupling a condenser of a refrigeration system to an expansion valve of the refrigeration system.

17. The method of claim 16:

wherein the refrigerant from the evaporator coils is superheated and converted to a vapor state in the evaporator header by heat from the refrigerant flowing through the liquid line when the refrigerant from the evaporator coils comes in contact with the portion of the liquid line in the inner cavity defined by the evaporator header, and wherein the refrigerant from the evaporator coils is in a two-phase state that is a mixture of a liquid state and the vapor state; while the refrigerant that flows through the liquid line is in the liquid state and has a higher temperature than the refrigerant from the evaporator coils.

18. The method of claim 16, wherein the liquid suction heat exchangers is disposed in a housing of the evaporator.

* * * * *